United States Patent [19]

Hoeberechts et al.

[11] Patent Number: 4,682,074

[45] Date of Patent: Jul. 21, 1987

[54] ELECTRON-BEAM DEVICE AND SEMICONDUCTOR DEVICE FOR USE IN SUCH AN ELECTRON-BEAM DEVICE

[75] Inventors: Arthur M. E. Hoeberechts; Gerardus G. P. van Gorkom, both of Eindhoven, Netherlands

[73] Assignee: U.S. Philips Corporation, New York, N.Y.

[21] Appl. No.: 793,883

[22] Filed: Nov. 1, 1985

[30] Foreign Application Priority Data

Nov. 28, 1984 [NL] Netherlands ..... 8403613

[51] Int. Cl.[4] ..... H01J 29/04

[52] U.S. Cl. ..... 313/444; 313/446; 357/13

[58] Field of Search ..... 313/446, 447, 424, 390, 313/444, 366; 357/13

[56] References Cited

U.S. PATENT DOCUMENTS 4,147,953 4/1979 Esteron ..... 313/447 X
4,259,678 3/1981 van Gorkom et al. ..... 357/13
4,303,930 12/1981 van Gorkom et al. ..... 357/13
4,370,797 2/1983 van Gorkom et al. ..... 313/366 X
4,574,216 3/1986 Hoeberechts et al. ..... 313/446 X

*Primary Examiner*—Palmer C. DeMeo
*Attorney, Agent, or Firm*—Robert J. Kraus

[57] ABSTRACT

A device for recording or displaying images or for electron lithographic or electron microscopic uses, comprising in an evacuated envelope (1) a target (7) on which at least one electron beam (6) is focussed. This beam is generated by means of a semiconductor device (10) which comprises an electrically insulating layer (42) having an aperture (38) through which the beam passes. The layer carries at least four beam-forming electrodes (43 through 50) which are situated at regular intervals around the aperture (38). Each of the electrodes has such a potential that an n-pole field or a combination of n-pole fields is generated, where n is an even integer from 4 through 16. A suitable choice of the n-pole field will make it possible to impart substantially any desired shape to the beam (6) and thus the focus on the target.

20 Claims, 9 Drawing Figures

ELECTRON-BEAM DEVICE AND SEMICONDUCTOR DEVICE FOR USE IN SUCH AN ELECTRON-BEAM DEVICE

BACKGROUND OF THE INVENTION

The invention relates to an electron-beam device comprising in an evacuated envelope a target onto which at least one electron beam is focussed and a semiconductor emitter device for generating the electron beam. The semiconductor emitter device comprises a semiconductor body with a major surface which carries a first electrically insulating layer having at least one aperture, which semiconductor body comprises a pn-junction. In the semiconductor body, electrons can be generated by means of avalanche multiplication by applying a reverse voltage across the pn-junction. The electrons emanate from the semiconductor body at the location of the aperture in the first electrically insulating layer to form the electron beam. The first insulating layer carries an accellerating electrode which is situated at the edge of the aperture, and which is at least partly covered with a second electrically insulating layer which leaves the aperture in the first insulating layer exposed and which carries electrodes for influencing the electron beam.

The invention also relates to an electron-beam device comprising in an evacuated envelope a target onto which at least one electron beam is focussed and a semiconductor emitter device for generating this electron beam. The semiconductor emitter device comprise a semiconductor body having at a major surface a p-type surface zone, which zone has at least two connections. At least one of the connections is an injecting connection whose distance from the major surface is at most equal to the diffusion-recombination length of electrons in the p-type surface zone. The major surface is covered at least partly, with an electrically insulating layer formed with an aperture which leaves at least a part of the p-type surface zone exposed and which carries electrodes for influencing the electron beam.

The invention relates in addition to a semiconductor emitter device for use in such an electron-beam device.

Such devices are known from Netherlands Patent Application No. 8,104,893 (corresponding to U.S. Pat. No. 4,574,216) which is laid open to public inspection and is considered to be incorporated herein by reference.

The electron-beam device may be a television camera-tube. In this case the target is a photosensitive layer. However, the electron-beam device may also be a cathode-ray tube for displaying monochrome or coloured images. In that case, the target is a layer or a pattern of lines or dots of fluorescent material (phosphor). The electron-beam device may, however, also be designed for electron lithographic or electron microscopic uses.

Netherlands Patent Application No. 7,905,470 (corresponding to U.S. Pat. No. 4,303,930) which is laid open to public inspection and is considered to be incorporated herein by reference, illustrates a cathode-ray tube comprising a semiconductor emitter device, a so-called "cold cathode". The operation of this cold cathode is based on the emanation of electrons from a semiconductor body in which a pn-junction is reverse-biased in such a way that avalanche multiplication of charge carriers occurs. Some electrons may then obtain so much kinetic energy as is necessary to surpass the electron work function. These electrons are then released at the major surface of the semiconductor emitter body and hence, provide an electron current.

Emanation of electrons is facilitated in the device shown by providing the semiconductor device with accelerating electrodes on an insulating layer which is situated on the major surface, which accelerating electrodes leave exposed an annular, circular, slot-shaped or rectangular aperture in the insulating layer. In order to further facilitate the emanation of electrons, the semiconductor surface is provided, if desired, with an electron work function-reducing material, for example cesium.

Netherlands Patent Application No. 7,800,987 (corresponding to U.S. Pat. No. 4,259,678), which is laid open to public inspection and is considered to be incorporated herein by reference, discloses a similar type of "cold cathode" in which the pn-junction is left, exposed at the major surface of the semiconductor body.

As a certain amount of residual gases inevitably remains in the evacuated envelope, negative and positive ions are liberated from these residual gases by the electron current. The negative ions are accelerated in the direction of the target. In the case of electrostatic deflection, they may be incident on a small area of the target and either damage or disturb its operation. Under the influence of accelerating and focussing fields in the tube, some of the positive ions will move in the direction of the cathode. If no special measures are taken, some of the positive ions will be incident on the semiconductor and a kind of ion-etching will take place causing damage to the semiconductor. This damage may be a gradual etching away of the electron work function-reducing material. A redistribution or even total disappearance of this material causes the emission properties of the cathode to change. If there is no such layer (or if it has been removed by the above-mentioned etching mechanism), even the major surface of the semiconductor body may be effected. A solution of this problem is provided by the above-mentioned Netherlans Patent Application No. 8,104,893, which is considered to be incorporated herein by reference. Due to the use of an additional electrically insulating layer on which at least two deflection electrodes for generating a dipole field are present, the positive ions are made to follow such a path that they do not, or hardly, impinge on the emissive part of the cathode. The electron beam is deflected by the dipole field, In the field of electron optics, there is an increasing need for a qualitatively suitable electron-beam focus on the target, i.e. a focus having the required shape and dimensions and without a halo around it.

SUMMARY OF THE INVENTION

It is an object of the invention to provide an electron-beam device of the type described in the first two paragraphs, which makes it posssible to statically and dynamically adjust the shape of the focus created by the electrons, for example alternating static with dynamic during deflection of the electron beam.

A device of the type described in the second paragraph is characterized, according to the invention, in that the electrodes on the electrically insulating layer comprise at least four beam-forming electrodes which are regularly spaced around the aperture and which each have such a potential that an n-pole field or a combination of n-pole fields is generated in which n is an even integer which is from 4 through 16. In such a device, the insulating layer may be split into a first and a second insulating layer between which an accelerating electrode can be interposed around the aperture.

The beam and the focus can be given almost any desired shape by chosing the proper n-pole field. The shape of the focus is very important in electron lithographic and electron microscopic applications. However, also in display tubes an astigmatic beam is often desired which, after passing through an astigmatic focussing lens or system of deflection coils, will result in a round focus.

The aperture may be substantially round or oblong. However, it is also possible to have a rectangular aperture with rounded corners.

The beam-forming electrodes are most effective if part of the edge of the electrodes coincides with part of the edge of the aperture.

The focus can be given almost any desired shape by providing six or eight beam-forming electrodes around the aperture.

Moreover, the beam-forming electrodes may be provided with such a potential that apart from the beam-forming n-pole field also a di-pole field is generated, for example, to act as an ion trap as described in the above-mentioned Netherlands Patent Application No. 8104893.

Beam-forming electrodes can easily be given respective potentials if the potentials on the beam-forming electrodes are obtained, at least in part, by voltage division by means of resistors arranged on the insulating layer on which the beam-forming electrodes are provided. These resistors may consist of resistive strips, for example polysilicon strip, which are provided in a way known in the art of semiconductors.

The semiconductor emitter device may also comprise several independently-controllable pn-junctions for generating electrons, and it may be provided with a common aperture associated with these pn-junctions and common beam-forming electrodes and accelerating electrodes.

One semiconductor emitter device for use in an electron-beam device in which the invention can be advantageously incorporated, includes a semiconductor body having a major surface which carries a first insulating layer having an aperture. The semiconductor body comprises a pn-junction, and in the semiconductor body electrons are generated by means of avalanche multiplication by applying a reverse voltage across the pn-junction. The electrons emanate from the semiconductor body at the location of the aperture in the first insulating layer, which carries an accelerating electrode situated at least at the edge of aperture. The electrode is covered, at least in part, with a second electrically insulating layer which leaves the aperture in the first insulating layer exposed and which carries electrodes. In accordance with the invention, the second electrically insulating layer carries at least six beam-forming electrodes situated at regular intervals around the aperture. The first electrically insulating layer and the accelerating electrode may be omitted.

Another type of semiconductor emitter device in which the invention can be advantageously incorporated comprises a semiconductor body having at a major surface a p-type surface zone, which zone has at least two connections, at least one of which is an injecting connection whose distance from the major surface is at most equal to the diffusion-recombination length of electrons in the p-type surface zone. The major surface is covered, at least in part, with an electrically insulating layer formed with an aperture which leaves at least a part of the p-type surface zone exposed and which carries at least six beam-forming electrodes which are regularly spaced around the aperture. In such a device, the insulating layer may be split into a first and a second insulating layer between which an accelerating electrode is interposed around the aperture.

With six or eight beam-forming electrodes the focus can be given nearly any required shape. By mounting voltage-dividing resistors between a number of beam-forming electrodes, it becomes possible to apply the proper potential to the beam-forming electrodes by means of a limited number of voltages. Preferably, these resistors consist of polysilicon strips. The potential—which causes avalanche multiplication—or the current supplied to the semiconductor cathode may contain information (for example by modulating). This is of importance in, for example, electron microscopy, electron lithography and in oscilloscope tubes.

BRIEF DESCRIPTION OF THE DRAWING

The invention will now be described, by way of example with reference to the accompanying drawing figures, in which.

DESCRIPTION OF THE PREFERRED EMBODIMENTS

Figure 1:
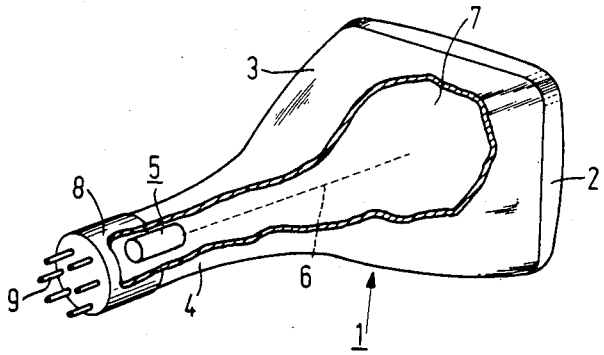
FIG. 1 is an exploded view of a device in accordance with the invention.

FIG. 1 is an exploded view of an electron-beam device, in this case a cathode-ray tube, in accordance with the invention. This cathode-ray tube comprises an evacuated glass envelope 1, which consists of a face plate 2, a funnel-shaped portion 3 and a neck 4. In the neck, an electron gun 5 is mounted for generating an electron beam 6 which is focussed onto a picture screen 7. The electron beam is deflected over the picture screen by means of deflection coils (not shown) or electric fields. Neck 4 is provided with a base 8 having connection pins 9.

Figure 2:
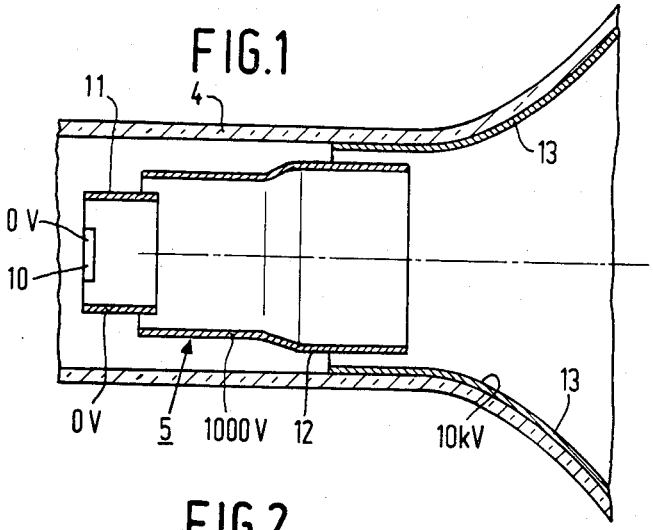
FIG. 2 is a longitudinal sectional view of a detail of FIG. 1.

FIG. 2 is a longitudinal sectional view of a portion of neck 4 and electron gun 5. This gun comprises a semiconductor emitter device 10 for generating the electron beam which is focussed and accelerated by means of cylindrical lens electrodes 11 and 12 and a conductive wall coating 13. The voltages most commonly applied to the electrodes and the wall coating are shown in this Figure. Electrode 11 is 5 mm long and has a diameter of 10 mm. Electrode 12 is 20 mm long and has a diameter which increases from 12 to 20 mm. The electrodes 11 and 12 overlap 1 mm. The electrode 12 and the conductive coating 13 overlap 5 mm.

Figure 3:
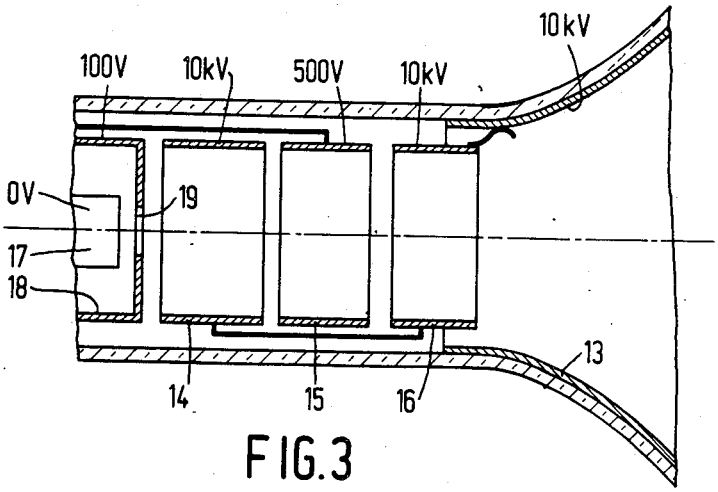
FIG. 3 is a longitudinal sectional view of an electron gun in a neck.
Figure 4:
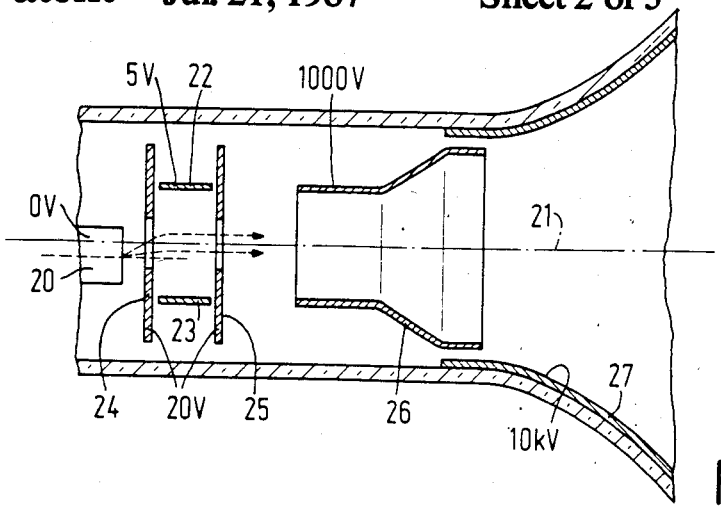
FIG. 4 is a longitudinal sectional view of an electron gun having an ion trap in the neck of a tube.

As shown in the longitudinal sectional view of FIG. 3, the accelerating lens shown in FIG. 2 may alternatively be replaced by a "unipotential lens". This lens consists of three cylindrical electrodes 14, 15 and 16. Opposite the emitting surface of the semiconductor emitter device 17 there is a beaker-shaped accelerating electrode 18 having a central aperture 19 in its bottom. The voltages most commonly applied to the electrodes and the wall coating are indicated in this Figure. Yet another possibility is shown in FIG. 4 in which a semiconductor emitter device 20 has a central axis which is offset from the tube axis 21, which is also the electron-gun axis. When by means of a dipole field the electron beam is made to emerge from the semiconductor emitter at an angle and is subsequently deflected parallel to the tube axis by means of deflection plates 22 and 23, an electron gun having an ion trap is obtained. This gun further comprises two diaphragm electrodes 24 and 25 having apertures with a diameter of 0.7 mm and a widening cylinder electrode 26. Electrode 26 and conductive coating 27 together form an accelerating lens. The distance between electrodes 24 and 25, as between electrodes 25 and 26, is 3 mm. The distance between semiconductor device 20 and electrode 24 is 1 mm. The voltages most commonly applied to the electrodes and to the deflection plates are indicated in this Figure.

Figure 5:
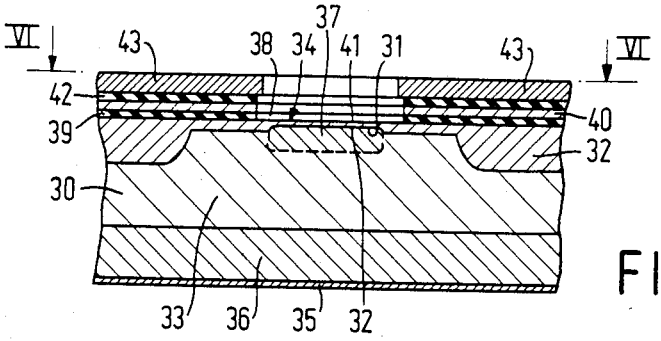
FIG. 5 is a sectional view of a semiconductor emitter device for use in an image reproduction or image recording device in accordance with the invention.

FIG. 5 is a sectional view of a semiconductor emitter device for use in an electron-beam device in accordance with the invention. This semiconductor emitter device comprises a semiconductor body 30 which, in this example, is made of silicon. The body comprises an n-type surface layer 32 which is provided at the major surface 31 of the semiconductor body, and which together with p-type areas 33 and 37 forms pn-junction 34. When a sufficiently high reverse voltage is applied across the pn-junction 34, electrons can emerge from the semiconductor body which are generated by avalanche multiplication. The semiconductor emitter device further comprises connection electrodes (not shown) which contact n-type surface layer 32. In the present example, p-type area 33 is contacted at the bottom by a metal layer 34. This contact takes place, preferably, via a highly doped p-type contact layer 36. In the present example, the donor concentration at the surface in n-type layer 32 is, for example, $5.10^{19}$ atoms/cm$^3$ while the acceptor concentration in p-type area 33 is much lower, for example, $10^{16}$ atoms/cm$^3$. In order to locally reduce the break-through voltage of pn-junction 34, the semiconductor emitter device has been provided with a higher doped p-type area 37 which forms the pn-junction with n-type area 32. This p-type area 37 is located within an aperture 38 in a first insulating layer 39 on which a polycrystalline silicon (polysilicon) accelerating electrode 40 has been provided around aperture 38. Insulating layer 39 and accelerating electrode 40 may be emitted. The electron emission may be increased by covering semiconductor surface 41 within aperture 38 with a work function-reducing material, for example, a layer of a material containing barium or cesium. For further details of such a semiconductor device, also called a semiconductor cathode, reference is made to the above-mentioned Netherlands Patent Application No. 7,905,470, which is laid open to public inspection. The semiconductor device further comprises a second insulating layer 42 which carries beam-forming electrodes 43 through 50 (only 43 is visible in this figure) which are made of, for example, aluminium.

Figure 6:
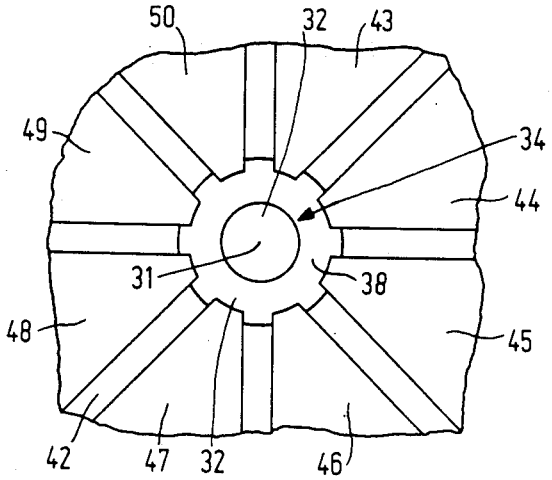
FIG. 6 is a view of the semiconductor emitter device shown in FIG. 5.

FIG. 6 is a view of the semiconductor emitter device in accordance with FIG. 5. Eight beam-forming electrodes, 43 through 50, have been provided around major surface 31 of pn-junction 34 and aperture 38. By means of these eight electrodes, substantially any multipole field and combination of multi-pole field can be formed. It is also possible to use sixteen electrodes. However, using more electrodes is pointless and unnecessarily expensive.

Figure 7:
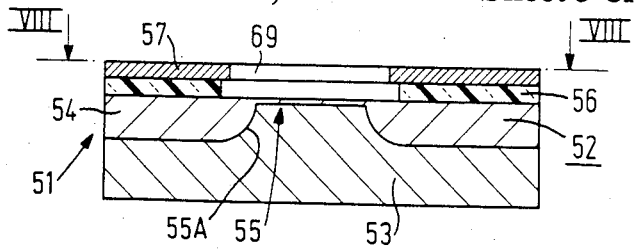
FIG. 7 is a sectional view of another embodiment of a semiconductor emitter device for use in an image reproduction or image recording device in accordance with the invention.

FIG. 7 is a sectional view of another embodiment of a semiconductor emitter device 51 based on avalanche breakdown of a pn-junction. In the present example, semiconductor body 52 comprises a p-type substrate 53 and an n-type layer 54, between which extends pn-junction 55. Also in this case, avalanche multiplication takes place, yet limited to a certain area. This is achieved by forming at the location of the deep n-diffusion a linear gradient 55A in the junction area with p-type silicon and by forming a stepped junction in the central part at the location of the shallow n-diffusion. The semiconductor body carries an insulating layer 56 on which polysilicon beam-forming electrodes 57 through 68 (only 57 is visible in this figure) have been provided around aperture 69. Between n-type area 54 and insulating layer 56, an additional insulating layer may be applied which carries an accelerating electrode at the edge of the insulating layer 56 around aperture 69.

Figure 8:
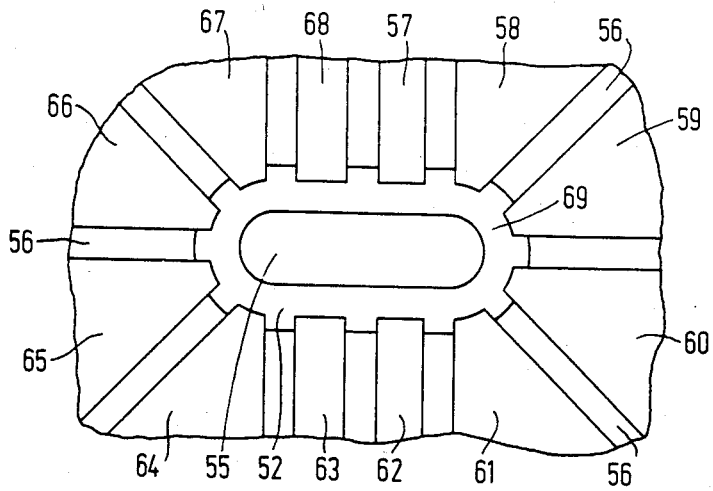
FIG. 8 is a view of the semiconductor emitter device shown in FIG. 7

FIG. 8 is, by analogy with FIG. 6, a view of the semiconductor emitter device in accordance with FIG. 7. In this case, it relates to an oblong device by means of which an electron beam having an oblong section can be generated. A substantially rectangular focus can be obtained by generating a suitable multipole by means of electrodes 57 through 68. The focus can very suitably be used in electron lithographic processes. It will be obvious that the invention is not limited to this embodiment, and that many more oblong embodiments can suitably be used.

Figure 9:
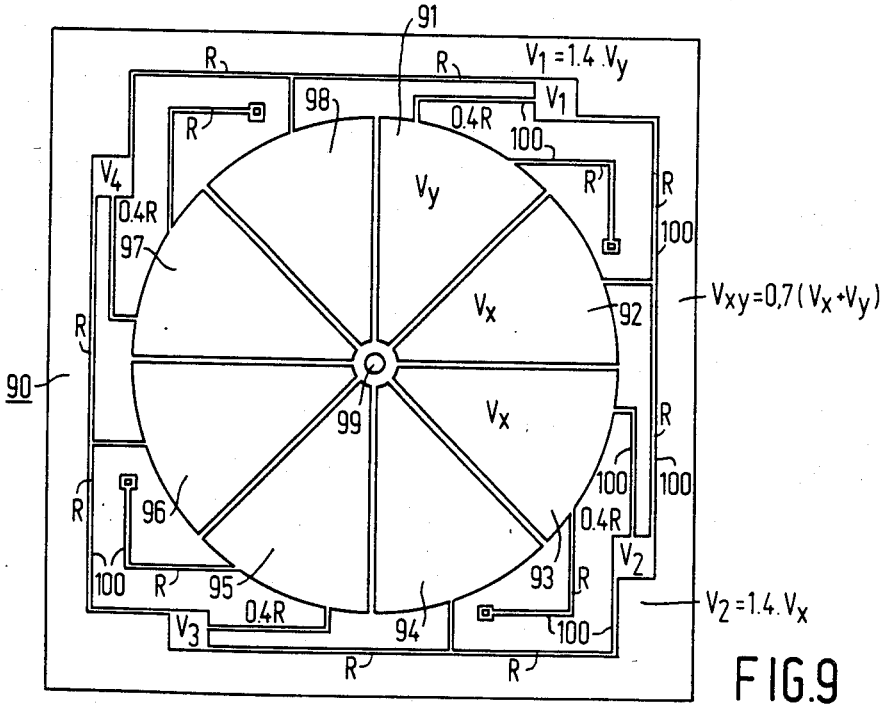
FIG. 9 is a view of a semiconductor emitter device having voltage-dividing resistors.

FIG. 9 is a view of a semiconductor emitter device 90 having, by analogy with the device in accordance with FIG. 6, eight beam-forming electrodes, 91 through 98, which are grouped around a pn-junction 99. The voltage can be applied to electrodes 91 through 98 using voltage dividers so that fewer voltage sources ($V_1$ through $V_4$) are needed. The voltage dividers are formed by resistive polysilicon strips 100 with, in the present embodiment, resistances R and 0.4 R. The resistance values are determined by the choice and the geometry (width and thickness of the strips) of the material and by a possible doping of said material (for example polysilicon). These are known techniques in the art of semiconductors.

By means of the four through sixteen beam-forming electrodes, not only mere n-pole fields (four, six, eight, ten, twelve, fourteen and sixteen-pole fields) can be generated but also combinations of these n-pole fields, in which the value of n is always equal to a number from the following range: 4, 6, 8, 10, 12, 14 or 16 (even and integer numbers). For example, a combination of a four, an eight and a twelve-pole field is possible, but also a combination of a four, a six and a sixteen-pole field. By means of these combinations of n-pole fields, the focus of the electron beam formed can be given nearly any required shape.

What is claimed is:

1. An electron-beam device comprising in an evacuated envelope a target onto which at least one electron beam is focussed and a semiconductor emitter device for generating the at least one electron beam, which semiconductor emitter device comprises a semiconductor body having a major surface supporting a first electrically insulating layer having at least one aperture, which semiconductor body comprises at least one pn-junction at which electrons can be generated by means of avalanche multiplication by applying a reverse voltage across the pn-junction, which electrons emanate from the semiconductor body at the location of the aperture in the first electrically insulating layer to form the electron beam, which first insulating layer supports at least one accelerating electrode having a portion thereof disposed adjacent the edge of said aperture, said electrode being at least partly covered with a second electrically insulating layer which leaves the aperture in the first insulating layer exposed and which carries electrodes for influencing the electron beam, characterized in that the electrodes on the second electrically insulating layer comprise at least four-beam forming electrodes which are regularly spaced around the aperture and have means electrically connected thereto for applying respective potentials for producing at least one n-pole field, where n is an even integer which is greater than or equal to 4 and smaller than or equal to 16.

2. An electron-beam device comprising in an evacuated envelope a target onto which at least one electron beam is focussed and a semiconductor emitter device for generating the at least one electron beam, which semiconductor emitter device comprises a semiconductor body having a major surface supporting a first electrically insulating layer having at least one aperture, which semiconductor body comprises at least one pn-junction at which electrons can be generated by means of avalanche multiplication by applying a reverse voltage across the pn-junction, which electrons emanate from the semiconductor body at the location of the aperture in the first electrically insulating layer to form the electron beam, characterized in that on the electrically insulating layer at least four beam-forming electrodes are provided which are regularly spaced around the aperture and have means electrically connected thereto for applying respective potentials for producing at least one n-pole field, where n is an even integer which is greater than or equal to 4 and smaller than or equal to 16.

3. An electron-beam device comprising in an evacuated envelope a target onto which at least one electron beam is focussed and a semiconductor emitter device for generating the at least one electron beam, which semiconductor emitter device comprises a semiconductor body having at a major surface thereof a p-type surface zone which has at least two connections, at least one being an injecting connection whose distance from the major surface is at most equal to the diffusion-recombination length of electrons in the p-type surface zone, which major surface is covered, at least in part, with a first electrically insulating layer formed with an aperture which leaves at least a part of the p-type surface zone exposed and which carries electrodes for influencing the electron beam, characterized in that the electrodes on the electrically insulating layer comprise at least four beam-forming electrodes which are regularly spaced around the aperture and have means electrically connected thereto for applying respective potentials for producing at least one n-pole field, where n is an even integer which is greater than or equal to 4 and smaller than or equal to 16.

4. An electron-beam device comprising in an evacuated envelope a target onto which at least one electron beam is focussed and a semiconductor emitter device for generating the at least one electron beam, which semiconductor emitter device comprises a semiconductor body having at a major surface a p-type surface zone, which zone has at least two connections, at least one being an injecting connection whose distance from the major surface is at most equal to the diffusion-recombination length of electrons in the p-type surface zone, which major surface is covered, at least in part, with a first electrically insulating layer formed with an aperture which leaves at least a part of the p-type surface zone exposed, characterized in that this electrically insulating layer carries at least one accelerating electrode having a portion thereof disposed adjacent the edge of said aperture, said electrode being covered, at least in part, with a second electrically insulating layer which leaves the aperture in the first insulating layer exposed and which carries at least four beam-forming electrodes which are regularly spaced around the aperture and have means electrically connected thereto for applying respective potentials for producing at least one n-pole field, where n is an even integer which is greater than or equal to 4 and smaller than or equal to 16.

5. An electron-beam device as claimed in claims 1, 2, 3 or 4, characterized in that the aperture is mostly round.

6. An electron-beam device as claimed in claims 1, 2, 3 or 4, characterized in that the aperture is mostly oblong.

7. An electron-beam device as claimed in claim 6, characterized in that the aperture is rectangular with rounded corners.

8. An electron-beam device as claimed in claim 1, 2, 3 or 4, characterized in that part of the edge of the beam-forming electrodes coincides with part of the edge of the aperture.

9. An electron-beam device as claimed in claim 1, 2, 3 or 4, characterized in that six beam-forming electrodes are provided around the aperture.

10. An electron-beam device as claimed in claim 1, 2, 3 or 4, characterized in that eight beam-forming electrodes are provided around the aperture.

11. An electron-beam device as claimed in claim 1, 2, 3 or 4, characterized in that the beam-forming electrodes each have such a potential that not only an n-pole field but also a di-pole field is generated.

12. An electron-beam device as claimed in claim 1, 2, 3 or 4, characterized in that the potentials on the beam-forming electrodess are obtained, at least in part, by voltage division using resistors which are provided on the insulating layer which carries the beam-forming electrodes.

13. An electron-beam device as claimed in claim 12, characterized in that the resistors are made of polysilicon.

14. A semiconductor emitter device comprising a semiconductor body having a major surface supporting a first electrically insulating layer having an aperture, which semiconductor body comprises at least one pn-junction at which electrons can be generated by means of avalanche multiplication by applying a reverse voltage across the pn-junction, which electrons emanate from the semiconductor body at the location of the aperture, said first electrically insulating layer supporting at least one accelerating electrode having a portion thereof disposed adjacent the edge of said aperture, said electrode being covered, at least in part, with a second electrically insulating layer which leaves the aperture in the first electrically-insulating layer exposed and which carries electrodes, characterized in that the second electrically insulating layer carries at least six beam-forming electrodes situated at regular intervals around the aperture, said electrodes having means electrically connected thereto for applying respective potentials for producing at least one n-pole field, where n is an even integer from 4 through 16.

15. A semiconductor emitter device comprising a semiconductor body having at a major surface thereof a p-type surface zone which has at least two connections, at least one being an injecting connection whose distance from the major surface is at least equal to the diffusion-recombination length of electrons in the p-type surface zone, which major surface is covered, at least in part, with an electrically insulating layer formed with an aperture which leaves at least a part of the p-type surface zone exposed and which carries electrodes, characterized in that six beam-forming electrodes are provided on the electrically insulating layer at regular intervals around the aperture, said electrodes having means electrically connected thereto for applying respective potentials for producing at least one n-pole field, where n is an even integer from 4 through 16.

16. A semiconductor emitter device comprising a semiconductor body having a major surface supporting an electrically insulating layer having an aperture, which semiconductor body comprises at least a pn-junction at which electrons can be generated by means of avalanche multiplication by applying a reverse voltage across the pn-junction, which electrons emanate from the semiconductor body at the location of the aperture in the electrically insulating layer, characterized in that the electrically insulating layer carries at least six beam-forming electrodes at regular intervals around the aperture, said electrodes having means electrically connected thereto for applying respective potentials for producing at least one n-pole field, where n is an even integer from 4 through 16.

17. A semiconductor emitter device comprising a semiconductor body having at a major surface a p-type surface zone, which zone has at least two connections, at least one being is an injecting connection whose distance from the major surface is at least equal to the diffusion-recombination length of electrons in the p-type surface zone, which major surface is covered, at least in part, with a first electrically insulating layer formed with an aperture which leaves at least a part of the p-type surface zone exposed, characterized in that this electrically insulating layer carries aat least one accelerating electrode having a portion thereof disposed adjacent the edge of said aperture, said electrode being covered, at least in part, with a second electrically insulating layer which leaves the aperture in the first insulating layer exposed and which carries at least four beam-forming electrodes situated at regular intervals around the aperture, said electrodes having means electrically connected thereto for applying respective potentials for producing at least one n-pole field, where n is an even integer from 4 through 16.

18. A semiconductor device as claimed in claim 14, 15, 16 or 17, characterized in that six or eight beam-forming electrodes are provided on the electrically insulating layer.

19. A semiconductor device as claimed in claim 14, 15, 16 or 17, characterized in that resistors are provided between at least a number of the beam-forming electrodes on the insulating layer.

20. A semiconductor device as claimed in claim 19, characterized in that the resistors comprise polysilicon strips.

* * * * *